United States Patent [19]

Hiatt et al.

[11] Patent Number: 4,760,616

[45] Date of Patent: Aug. 2, 1988

[54] BEDDING FOUNDATION HAVING SINUOUS WIRE SPRINGS

[75] Inventors: Sidney A. Hiatt; Henry Zapletal, both of Carthage, Mo.

[73] Assignee: Leggett & Platt, Incorporated, Carthage, Mo.

[21] Appl. No.: 38,503

[22] Filed: Apr. 15, 1987

[51] Int. Cl.[4] ..... A47C 23/02

[52] U.S. Cl. ..... 5/246; 5/247; 5/254; 5/255; 5/260; 267/95; 267/103

[58] Field of Search ..... 267/93, 95, 100, 102, 267/103, 86; 5/246, 247, 254, 255, 260, 474

[56] References Cited

U.S. PATENT DOCUMENTS

| | | | |
|---|---|---|---|
| 2,105,115 | 1/1938 | Gleason . | |
| 2,116,402 | 5/1938 | Menge . | |
| 2,526,250 | 10/1950 | Matthaei, Jr. . | |
| 2,705,527 | 4/1955 | Flint et al. . | |
| 2,798,233 | 7/1957 | Robell . | |
| 2,826,768 | 3/1958 | Drews . | |
| 2,979,739 | 4/1961 | Krakauer . | |
| 3,325,831 | 6/1967 | Crosby et al. . | |
| 3,577,574 | 5/1971 | Ciampa et al. . | |
| 3,725,965 | 4/1973 | Smith et al. . | |
| 3,825,960 | 7/1974 | Inman et al. . | |
| 3,833,948 | 9/1974 | Surletta et al. . | |
| 3,835,485 | 9/1974 | Klicki . | |
| 3,860,227 | 1/1975 | Hughes | 267/103 |
| 3,990,121 | 11/1976 | Whitaker . | |
| 4,100,631 | 7/1978 | Slone . | |
| 4,555,097 | 11/1985 | Hiatt . | |

*Primary Examiner*—Michael F. Trettel

*Attorney, Agent, or Firm*—Wood, Herron & Evans

[57] ABSTRACT

A box spring assembly includes a base frame, a top wire grid and a plurality of sinuous wire springs interconnecting the top wire grid and the base frame. The sinuous wire springs each comprise a sinuous wire strip formed into an inverted U-shaped configuration with the closed end of each U-shaped spring attached to the top wire grid and the free ends at the top of the U-shaped spring attached to the base frame.

6 Claims, 3 Drawing Sheets

BEDDING FOUNDATION HAVING SINUOUS WIRE SPRINGS

This invention relates to bedding foundations, and more particularly, to a box spring style of bedding foundation.

Prior art box springs or bedding foundations have generally included coil springs positioned in a vertical orientation so as to provide resilient support for a bedding mattress. In an effort to improve upon these conventional coil spring types of box spring or bedding foundation assemblies, numerous prior art assemblies have been developed which substitute formed wire springs for the more traditional coil springs. "Formed wire" springs is a term of art used to described springs which derive their resiliency from torsion bars rather than coils. Examples of formed wire springs embodied in box spring assemblies are to be found in U.S. Pat. Nos. 3,825,960; 3,833,948; and 3,835,485. Additionally, some prior art box spring assemblies have been developed which included combinations of coil and formed wire springs, as for example, the box spring assembly shown in U.S. Pat. No. 3,990,121. In those instances wherein formed wire springs and coil springs have been combined in a box spring, the formed wire springs have usually functioned to impart additional firmness to selected areas of the box spring, as for example, around the edge of the box spring or in the center section of the box spring.

A common problem with all box springs which utilize formed wire springs is that those box springs are relatively expensive to manufacture, primarily because the equipment upon which the formed wire spring portions of the box spring are manufactured are usually capable of making only one bend per stroke of a forming machine. Consequently, the formed wire springs, which generally have multiple bends formed therein, are expensive to produce, and the resulting box spring includes an expensive configuration of multiple formed wire springs.

It has therefore been an objective of this invention to provide an improved box spring which utilizes a novel formed wire spring to provide resilient support of the load supporting surface of the box spring, but which formed wire spring is relatively inexpensive to manufacture.

Still another objective of this invention has been to provide an improved box spring which has all of the resiliency and selective firmness characteristics of prior art box springs, but which may be manufactured and sold substantially less expensively.

The present invention is directed toward an improved box spring having relatively firm edge support but somewhat softer center support. The firm edge, according to the practice of this invention, is imparted by a novel formed wire spring having multiple torsion bar sections formed therein. This novel torsion bar containing formed wire spring, though, is one which is much less expensively produced and manufactured than prior art torsion bar formed springs which have heretofore characterized the prior art.

The formed wire springs manufactured in accordance with the practice of this invention are formed from conventional sinuous wire strips of the type having oppositely facing edge loops interconnected by straight torsion bar sections. According to the practice of this invention, these strips are bent into an inverted U configuration having substantially parallel vertical legs interconnected by a flat top section. The lower free ends of the vertical legs of the sinuous spring strips are, according to the practice of this invention, attached to the base frame, and the flat top interconnecting section of the strip is connected to the wire grid of the box spring assembly. Thus, the sinuous wire springs provide a resilient support for the load bearing top wire grid of the box spring.

According to the practice of this invention, these sinuous wire springs are selectively positioned within the spring assembly so as to generate the desired firmness at selected locations within the assembly.

Sinuous wire spring strips are very commonly used to form resilient load supporting portions of furniture seats. In fact, very nearly all automobile seats incorporate sinuous spring strips as the resilient load portion of both the seat and the backrest of the seat assembly. Consequently, the equipment for manufacturing sinuous wire spring strips is very highly developed, and such springs may therefore be very economically manufactured. This invention takes advantage of the technology for inexpensively manufacturing sinuous wire spring strips to reduce or minimize the cost of box spring assemblies by utilizing formed wire springs manufactured from sinuous wire spring strips for at least a portion of the resilient load supporting elements of the box spring.

Sinuous wire spring strips have in the past been utilized to provide edge support for a mattress or box spring. Examples of such edge supported sinuous wire springs may be found in U.S. Pat. Nos. 2,105,115; 2,826,768; and 2,798,233. To our knowledge, though, and except as disclosed in co-pending application Ser. No. 732,373 of Henry Zapletal, now abandoned sinuous wire spring strips have never been formed into generally U-shaped wire springs for providing the resilient support between a top wire grid and a bottom frame of a box spring.

In the above-identified application, Ser. No. 732,373, now abandoned, there is disclosed a U-shaped sinuous wire spring used in a bedding box spring, but as disclosed in that application, the closed end of the U-shaped spring is attached to the base frame of the box spring, and the open end is attached to the wire grid. This earlier construction has several disadvantages relative to this new construction wherein the U-shaped sinuous wire spring is inverted and attached to the base frame and wire grid. Specifically, this new inverted construction enables the arcuate top section of the spring to be fitted into a radiused corner of the box spring and attached to the radiused corner of the border wire of the grid. Additionally, the inverted orientation of the U-shaped sinuous wire spring enables the spring to be mounted upon a narrow transverse slat of the base frame because the free ends of the spring may be placed in a close, but spaced, adjacency and attached to a narrow transverse slat of the base frame. Further, because the closed end of the U-shaped spring is attached to the top wire grid rather than the base frame, the springs may be attached by metal clips directly to the border wire of the grid so as to provide better edge support of the resulting box spring.

These and other objects and advantages of the present invention will be more readily apparent from the following description of the drawings, in which.

Figure 1:
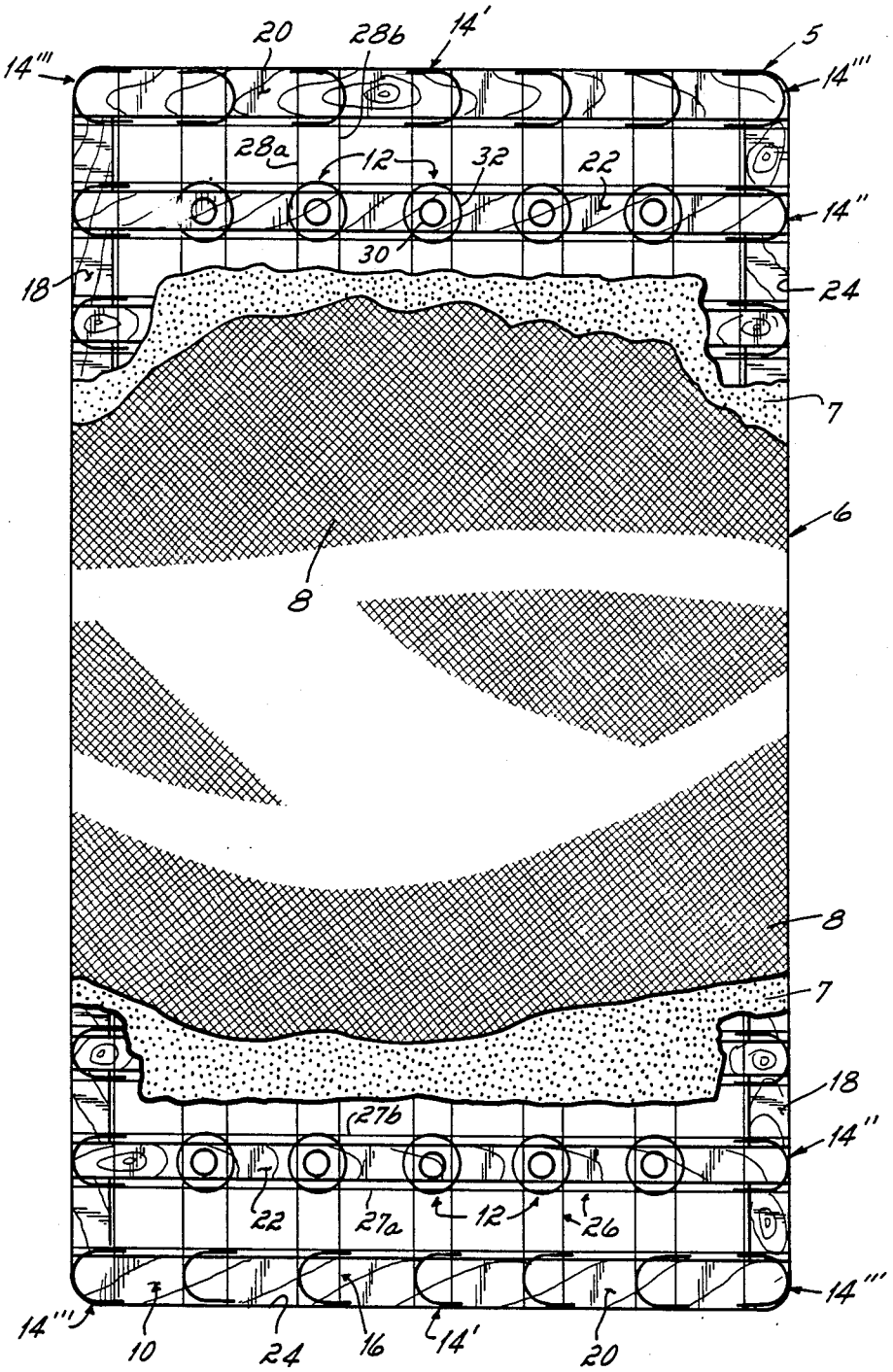
FIG. 1 is a top plan view, partially broken away, of a box spring assembly incorporating the invention of this application.
Figure 2:
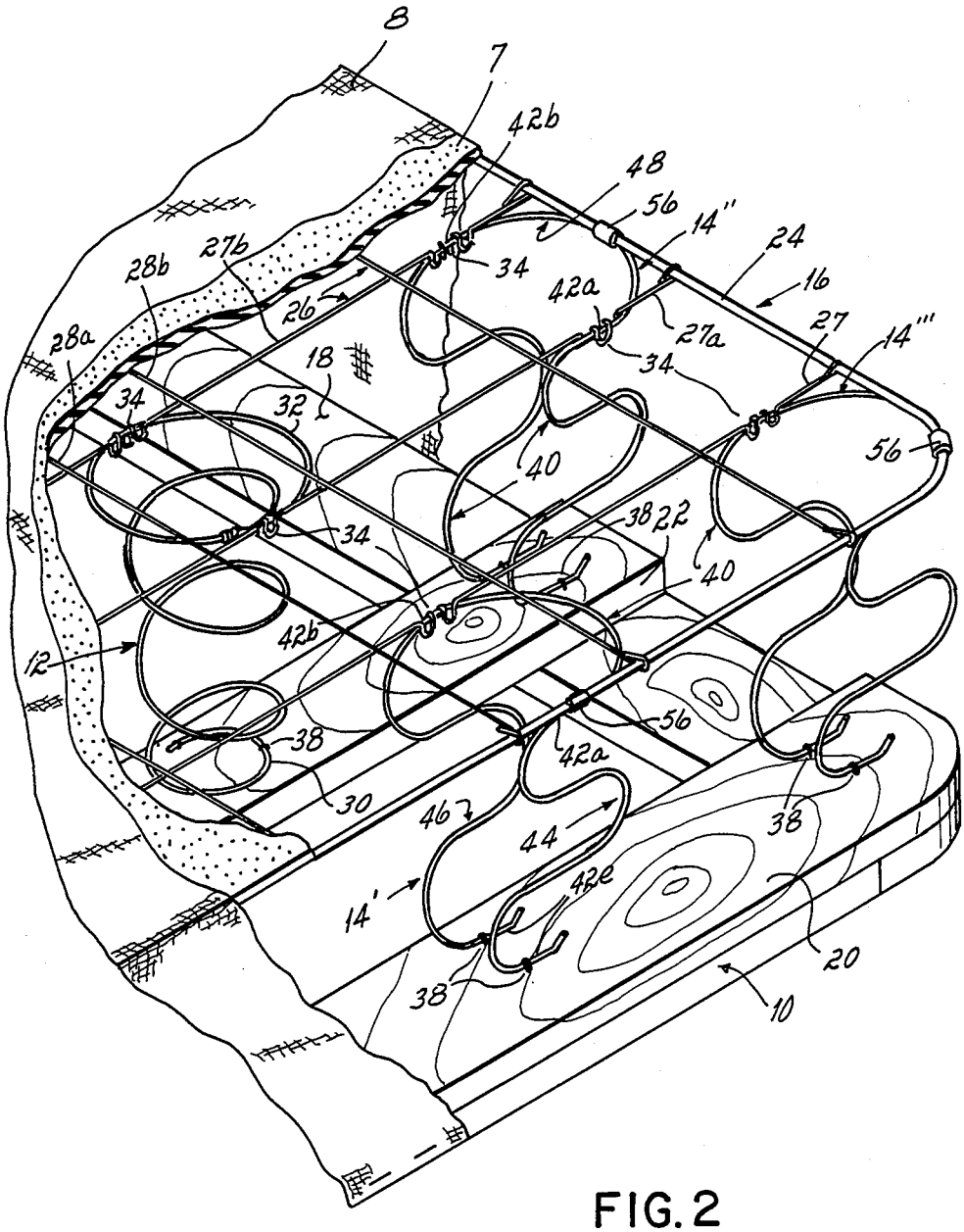
FIG. 2 is a perspective view of one corner portion of the box spring assembly of FIG. 1.
Figure 3:
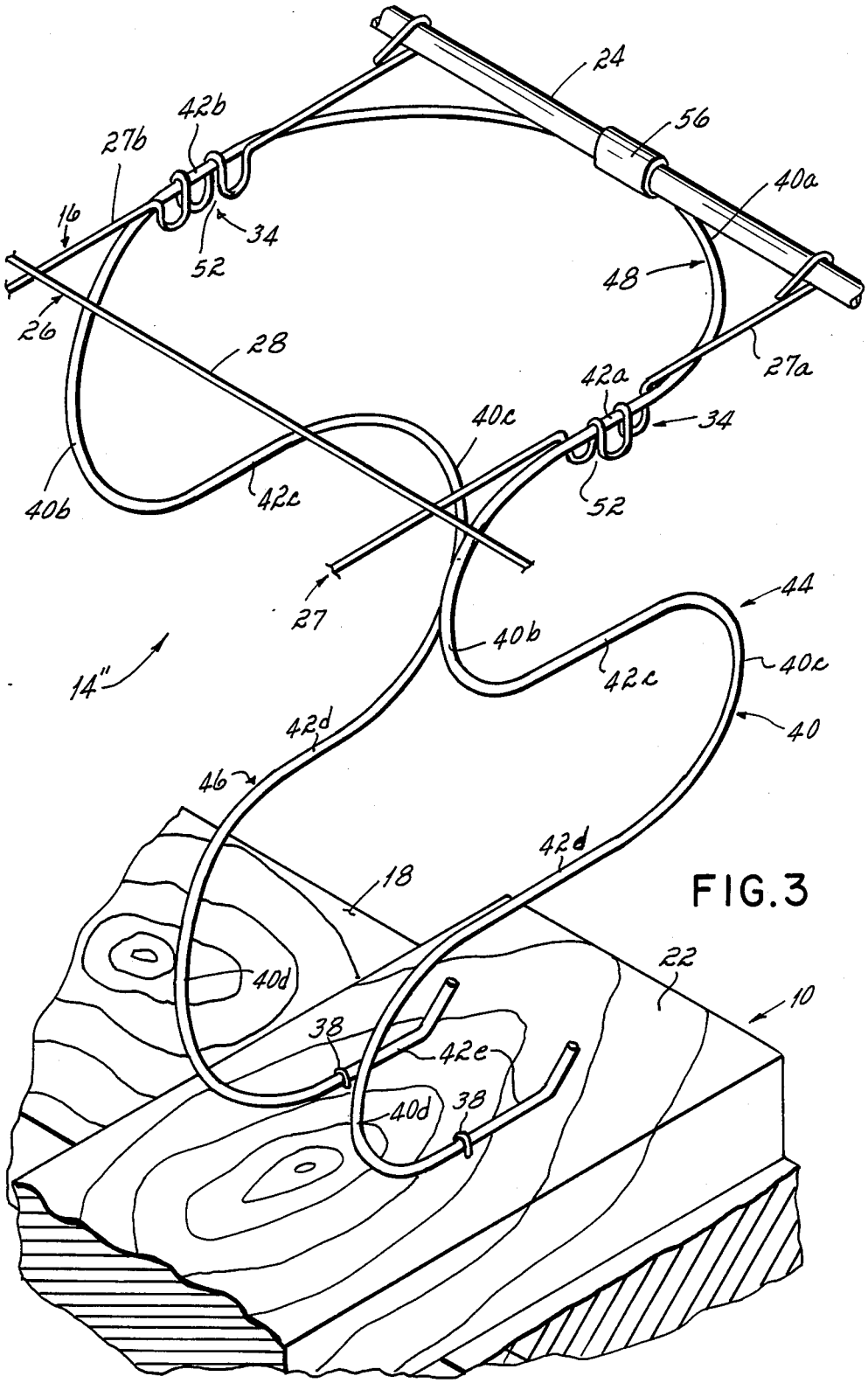
FIG. 3 is an enlarged perspective view of one portion of the box spring assembly of FIG. 2.

With reference first to FIGS. 1–3, it will be seen that the bedding foundation or box spring 5 of this invention includes a box spring assembly 6 over the top of which padding 7 is placed. The box spring assembly 6 and padding 7 are encased in an upholstered covering 8.

The box spring assembly 6 comprises a wooden base frame 10 upon the top of which there is mounted a plurality of coil springs 12 and sinuous wire spring 14 for supporting a top wire grid 16. The top wire grid 16 is intended to resiliently support a mattress as is conventional in the bedding industry.

The base frame 10 is rectangular in configuration and comprises a pair of longitudinally extending side boards 18 (FIG. 2), as well as a pair of transversely extending end boards 20, nailed or otherwise secured to the top of the side boards 18. Additionally, there are a plurality of wooden slats 22 which extend transversely across the rectangular base between the side boards 18. These slats are also nailed or otherwise fixedly secured to the top of the side boards 18.

The top wire grid 16 comprises a border wire 24 and a welded wire grid 26. The border wire 24 is formed into a rectangular configuration and overlies the peripheral edge of the rectangular base frame. The welded wire grid 26 is secured to and located in the plane of the border wire 24, the grid and border wire defining the top plane of the box spring assembly. The welded wire grid 26 comprises a plurality of spaced, transverse wires 27 and a plurality of spaced, longitudinal wires 28. All but the endmost ones of the transverse wires 27 are arranged in pairs 27*a*, 27*b*, and all but the sidemost ones of the longitudinal wire 28 are similarly arranged in pairs 28*a*, 28*b*. All of the wire 27 and 28 of the welded wire grid 26 extends between opposite sides and ends, respectively, of the rectangular border wire 24. These grid wires overlie the rows and columns of coil springs 12 and sinuous wire springs 14 so as to secure the top of those springs 12 and 14 against lateral and longitudinal displacement.

The ends of all the grid wires 27, 28 are hooked around the border wire 24 and are preferably welded to the border wire. The intersections or cross-over points of the transverse wires 27 and the longitudinal wires 28 are welded together, thereby providing an integral welded wire top grid. In manufacture, the border wire 24 and the welded wire grid 26 are all preformed into a welded top wire grid 16 subassembly.

The coil springs 12 utilized in the box spring assembly 5 of this invention are all conventional and are of the single cone type. These single cone coil springs 12 all have the bottom or small end turn 30 fixedly attached by staples 38 to the top of one of the slats 22 and have the top or large end turn 32 secured to the welded wire grid. The coils springs 12 are all vertically positioned within the assembly, i.e., the axis of each coil spring is oriented perpendicular to the parallel top and bottom planes of the box spring assembly. The top turn or loop 32 of each coil spring 12 is fixed to the wire grid by hooks 34 formed in the transverse wires 27 of the wire grid 16. Each transverse wire 27 of each pair of transverse wires 27*a*, 27*b* (each such pair serving a row of coil springs in the box spring assembly) is provided with a plurality of double reversely bent hooks 34 (FIG. 2) preformed into that transverse wire of the welded wire grid. Each hook 34 is formed as an open U-shaped element which opens downwardly so that the grid 16 may be placed over the top turns of the coil springs 12 with each top loop of each of the coil springs located in two opposed such hooks. The open portion of each U-shaped configured hook 34 is then bent or crimped to a closed condition so as to lock the coil springs top loop 32 within the U-shaped section of the hooks 34 of the transverse wires, i.e., so as to interconnect the coil springs with the top wire grid. Thus, each coil spring 12 is affixed only to the transverse grid wires 27 of the welded wire grid and not to the longitudinal grid wires 28 which overlie, but are not secured to, the top loop 32 of the coil springs. The hooks 34 in the transverse wires 27 are conventional and therefore have not been described in detail herein. A complete description of these hooks 34 and the manner in which they are formed may be found in Ciampa U.S. Pat. No. 3,577,574.

The outer edge of the top wire grid 16, including the four radiused corners, is connected to the wooden frame by the sinuous wire springs 14. With particular reference to FIGS. 2 and 3, it will be seen that each of these sinuous wire springs 14 comprises a sinuous wire spring strip made from wire bent back and forth upon itself into a conventional sinuous form so as to have oppositely facing edge loops 40 interconnected by straight torsion bar sections 42. According to the practice of this invention, each of these sinuous spring strips is formed into a generally inverted U-shaped configuration having substantially vertical legs 44, 46 interconnected at the top by a substantially flat top section 48. The flat top section 48 of each spring comprises a single edge loop 40*a* and a pair of straight torsion bar sections 42*a*, 42*b* connected to the opposite ends of the top edge loop 40*a*. The ends of these two straight torsion bar sections 42*a*, 42*b* extend from the opposite ends of the top edge loop 40*a* and are connected to the vertical legs 44, 46 of the spring.

Each vertical leg comprises three edge loops 40*b*, 40*c* and 40*d* interconnected by a pair of straight torsion bar sections 42*c*, 42*d*. The bottommost edge loop 40*d* in turn is connected to a free end torsion bar 42*e* which is connected to the base frame 10 by staples 38.

In the preferred practice of this invention, the edge loops 40*b*, 40*c* and 40*d* are of the same radius and are of lesser radius than the single edge loop 40*a* of the flat top section 48 of the springs 14. In one practice of the invention, the three edge loops 40*a*, 40*b* and 40*d* of the vertical legs 44, 46 of the springs are each approximately 2.4 centimeters in radius, and the single edge loop 40*a* of the top section of the springs is approximately 4.5 centimeters in radius. The vertical legs 44, 46 of the sinuous springs are, in the preferred practice of this invention, each displaced from a vertical plane through the straight torsion bars 42*a*, 42*b* by approximately 15°. In other words, both legs 44, 46 shape inwardly from the straight torsion bars 42*a*, 42*b* toward one another such that the torsion bar 42*a*, 42*b* are spaced apart approximately 9 centimeters, and the free end torsion bars 42*e* of each sinuous spring 14 are spaced apart by approximately 1.5 centimeters. The sinuous springs 14 and the round coil springs 12 are all approximately 14 centimeters in height.

In order to connect the flat top section 48 of the sinuous wire springs to the top wire grid 16 at locations intermediate the corners of the grid on the transverse ends of the box spring assembly 6 (see FIG. 2), the endmost sinuous wire springs 14′ intermediate the end corners are oriented so as to locate one straight torsion bar section 42a of the flat top section 48 in parallel with the border wire and in close adjacency thereto. These straight torsion bar sections 42a of the endmost sinuous wire spring 14' are connected by sheet metal clips 56 to the border wire. The straight torsion bar sections 42b on the opposite sides of these same endmost sinuous wire springs 14' underly one of the transverse wires of the grid and are received within U-shaped recesses 52 of the hooks 34 of these transverse wires of the grid After positioning of the torsion bar sections 42b within the recesses of the hooks, the hooks are crimped shut so as to securely lock the top sections 48 of the sinuous wire springs 14' to the top wire grid 16.

The sinuous wire springs 14'' which are located along the side edges of the box spring 5 are positioned such that the single edge loops 40a of the top section 48 of these springs 14'' are clipped to the longitudinal side edges of the border wire by sheet metal clips 56, and the two torsion bar sections 42a, 42b of the top sections 48 extend inwardly from the single edge loop section 40a. The two torsion bar sections 42a, 42b of each spring 14'' underlie two parallel transverse wires 27a, 27b of the transverse wires 27 of the grid top and are received within hooks 34 of these transverse wires. The hooks 34 are crimped shut about the torsion bar sections 42a, 42b of the top sections 48 of the spring 14'' so as to securely attach the sinuous springs 14'' to the grid. The free end torsion bars 42e of the side edge sinuous springs 14'' and the end edge sinuous springs 14' are connected to the top of the slats 22 and 20 by staples 38.

At the corners of the box spring assembly there are also U-shaped sinuous wire springs 14''' which interconnect the wooden base frame 10 to the top wire grid 16. These corner sinuous wire springs 14''' are oriented so that the single edge loop 40a of the flat top section of the spring fits in close adjacency to the rounded or radiused corner of the border wire and is connected thereto by a sheet metal clip 56. The positions of these corner springs is such that one torsion bar section 42a of the flat top section 48 lies adjacent to the end section of the border wire, and the other torsion bar section 42b underlies one transverse wire of the grid and is received within a reversely bent hook 34 of that transverse wire. The free end torsion bars 42e of each of these corner sinuous springs 14''' are connected to the top of the end boards 20 of the base frame 10 by conventional staples 38.

In practice, the box spring of FIGS. 1-3 is assembled by first nailing the end boards 20 to the tops of the side boards 18 and by nailing the slats 22 to the tops of these same side boards. The small diameter end loops of the coil springs 12 are then stapled to the tops of the slats 22. The bottom free end torsion bars 42e of the sinuous wire springs 14 are then stapled to the tops of the end boards 20 and the ends of the slats 22. The preassembled top wire grid 16 is then fitted over the top of the assembled wooden frame and springs so as to position the top turns or loops 32 of the coil springs 12 and the top section torsion bars 42a, 42b of the sinuous wire springs 14 within the U-shaped recesses 52 of the hooks 34 in the transverse wires 27 of the grid. The hooks are then crimped shut so as to secure the wire grid to the top loops of the coil springs and to the sinuous wire springs. The border wire is then connected by the sheet metal clips 56 to the sinuous wire springs 14. To complete the box spring assembly, a conventional fabric pad 7 is cverlaid over the top of the welded wire grid, and the complete assembly, including the rectangular wooden frame, the springs, the top wire grid, and the fabric pad, are enclosed within the upholstery covering 8.

While I have described only one preferred embodiment of my invention, persons skilled in this art will appreciate changes and modifications which may be made without departing from the spirit of my invention. For example, the mix and relative positioning of the coil springs and sinuous wire springs may be varied without departing from my invention. Therefore, I do not intend to be limited except by the scope of the following appended claims.

We claim:

1. A bedding foundation comprising, a bottom substantially rectangular, base frame having side and end members and slats extending between said side members, a substantially planar rectangular top wire grid, said grid comprising a border wire and first and second sets of wires, said border wire being of rectangular configuration and surrounding said first and second sets of wires, said first set of wires comprising a plurality of longitudinally extending, spaced, parallel wires and said second set of wires comprising a plurality of transversely extending, spaced, parallel wires, said first and second sets of wires intersecting one another and being fixedly connected to said border wires, a plurality of sinuous wire springs interconnecting said base frame and said wire grid, said sinuous wire springs each comprising a sinuous spring strip made from wire bent back and forth to have oppositely facing edge loops interconnected by straight torsion bar sections, each of said strips being formed into a generally U-shaped configuration having substantially vertical legs interconnected by a substantially flat horizontal section, said flat section of each of said sinuous wire springs being fixedly secured to said wire grid and the ends of said vertical legs of each of said sinuous springs remote from said flat section being fixedly secured to said base frame, each of said vertical legs of each of said U-shaped sinuous wire springs consisting of three edge loops interconnected by a pair of straight torsion bars, the lowermost one of the edge loops being connected to a third free end straight torsion bar, and said flat section of each of said U-shaped sinuous wire springs consisting of a single edge loop and a pair of straight torsion bars connected to opposite ends of said single edge loop, a fabric pad overlying said top wire grid, and an upholstered covering surrounding said base frame, top wire grid, sinuous wire springs, and said fabric pad.

2. A bedding foundation assembly comprising, a bottom, substantially rectangular, base frame having side and end members, a substantially planar rectangular top wire grid, said grid comprising a border wire and first and second sets of wires, said first set of wires comprising a plurality of longitudinally extending, spaced, parallel wires, said second set of wires comprising a plurality of transversely extending, spaced, parallel wires, the ends of both said first and second sets of wires being fixedly connected to said border wire, a plurality of sinuous wire springs interconnecting said base frame and said wire grid, said sinuous wire springs each comprising a sinuous spring strip made from wire bent back and forth upon itself to form oppositely facing edge loops interconnected by straight torsion bar sections, said spring strip being formed into a generally U-shaped configuration having substantially vertical legs interconnected by a flat horizontal section, said flat horizontal section of each of said sinuous wire springs being fixedly secured to said wire grid and the ends of said vertical legs of each said sinuous springs remote from said flat section being fixedly secured to said base frame, and each of said substantially vertical legs of each of said U-shaped sinuous wire springs consisting of three edge loops interconnected by a pair of straight torsion bars, the one of the edge loops most remote from the flat section being connected to a third free end straight torsion bar, and said flat section of each of said U-shaped sinuous wire springs consisting of a single edge loop and a pair of straight torsion bars connected to opposite ends of said single edge loop.

3. The bedding foundation assembly of claim 2 wherein said assembly has four radiused corners and said border wire has four radiused corners, one of said sinuous wire springs being located in each of the four corners of said assembly with said single edge loop of the sinuous wire springs extending substantially parallel to the radiused corners of the border wire.

4. The bedding foundation assembly of claim 3 wherein said single edge loop is of larger radius than said edge loop of said substantially vertical legs.

5. A bedding foundation assembly comprising, a bottom, substantially rectangular, base frame having side and end members, radiused corners, and slats extending between said side members, a substantially planar rectangular top wire grid, said grid comprising a border wire and first and second sets of wires, said border wire being of rectangular configuration and surrounding said first and second sets of wires, said border wire having radiused corners, said first set of wires comprising a plurality of longitudinally extending, spaced, parallel wires and said second set of wires comprising a plurality of transversely extending, spaced, parallel wires, said first and second sets of wires being fixedly connected to said border wire, a plurality of sinuous wire springs interconnecting the corners of said base frame and said wire grid, said sinuous wire springs each comprising a sinuous spring strip made from wire bent back and forth to have oppositely facing edge loops interconnected by straight torsion bar sections, each of said strips being formed into a generally U-shaped configuration having substantially vertical legs interconnected by a substantially flat section, said flat section of each of said sinuous wire springs being fixedly secured to said top wire grid and the ends of said vertical legs remote from said flat section of each of said sinuous springs being fixedly secured to said base frame, and each of said vertical legs of each of said U-shaped sinuous wire springs consisting of three edge loops interconnected by a pair of straight torsion bars, the endmost one of the edge loops remote from said flat section being connected to a third free end straight torsion bar, and said flat section of each of said U-shaped sinuous wire springs consisting of a single edge loop and a pair of straight torsion bars connected to opposite ends of said single edge loop, said single edge loop of said flat section of each of said sinuous springs being secured to one of said radiused corners of said border wire.

6. The foundation assembly of claim 5 wherein said single edge loop of each of said sinuous springs is of substantially larger radius than said edge loops of said vertical legs.

* * * * *